United States Patent [19]

Kuhnert et al.

[11] 4,419,440

[45] Dec. 6, 1983

[54] PROCESS FOR THE INTRODUCTION OF HYDROPHOBIC PHOTOGRAPHIC ADDITIVES

[75] Inventors: Lothar Kuhnert, Berlin; Burkhard Costisella, Neuenhagen; Christoph Roth, Halle-Neustadt; Walter Kroha, Wolfen; Wolfgang Baumbach; Renate Hoppe, both of Berlin, all of German Democratic Rep.

[73] Assignee: VEB Filmfabrik Wolfen, Woflen, German Democratic Rep.

[21] Appl. No.: 319,857

[22] Filed: Nov. 9, 1981

[30] Foreign Application Priority Data

Nov. 26, 1980 [DD] German Democratic Rep. ... 225482

[51] Int. Cl.[3] ..... G03C 1/40

[52] U.S. Cl. ..... 430/377; 430/449; 430/546; 260/932; 260/959; 260/961; 564/14

[58] Field of Search ..... 430/377, 546, 449; 564/14; 260/932, 959, 961

[56] References Cited

U.S. PATENT DOCUMENTS

| | | | |
|---|---|---|---|
| 3,385,704 | 5/1968 | Grabhofer et al. | 430/487 |
| 3,812,222 | 5/1974 | Kleiner et al. | 260/961 |
| 3,931,359 | 1/1976 | Schmidt et al. | 260/961 |
| 3,951,912 | 4/1976 | Susi | 260/961 |
| 4,104,377 | 8/1978 | Arlt et al. | 260/961 |
| 4,278,757 | 7/1981 | Mukunoki et al. | 430/512 |
| 4,317,782 | 3/1982 | Eckstein et al. | 260/932 |

*Primary Examiner*—J. Travis Brown

*Attorney, Agent, or Firm*—Jordan and Hamburg

[57] ABSTRACT

The present invention relates to a process for the introduction of water-insoluble photographic additives, especially dye couplers, in aqueous media with the application of high-boiling organic solvents. The purpose of the invention is to develop an improved process for the introduction of hydrophobic photographic additives, especially dye couplers, in gelatin or other hydrophilic bonding agents in order to produce stable dispersions suitable for storage. This invention has the object of creating a new, high-boiling solvent for the dispersion of hydrophobic photographic additives. According to the invention, this aim is achieved by employing phosphonic acid diamides, methane bisphosphonic acid diamides, phosphonic acid esters, methane bisphosphonic acid esters or mixed phosphonic acid esters or methane bisphosphonic acid ester amides as high-boiling solvents.

17 Claims, No Drawings

PROCESS FOR THE INTRODUCTION OF HYDROPHOBIC PHOTOGRAPHIC ADDITIVES

BACKGROUND OF THE INVENTION

The present invention relates to a process for the introduction of water-insoluble photographic additives, especially dye couplers, into aqueous media, under application of high boiling organic solvents.

In manufacturing of photographic materials, numerous hydrophobic components, especially dye couplers, stabilizers, optical brighteners etc. must be introduced into hydrophilic materials. As known, this is accomplished by dissolving the hydrophobic substances in an organic, high boiling solvent and dispersing this solution in an aqueous medium. Low-boiling auxiliary solvents, such as ethyl acetate or methylene chloride are often added, which are removed after dispersion. A dispersion is obtained wherein the dye couplers are present in the form of extremely fine droplets in the hydrophilic bonding agents of the photographic layer. Gelatin is preferably used as a hydrophilic bonding agent but other polymeric bonding agents may also be employed.

The high boiling solvents which are used for the dispersion of dye couplers must fulfill a series of requirements, including possession of the necessary good dissolving capacity for the couplers and prevention of crystallizing out of the dye couplers and of the image dyestuffs obtained after photographic development. They need to be compatible with the photographic development baths and they should not present any signs of separation from the bonding agents, even after a long period of storage, which would lead to clouding and, thereby, to a lowering of quality. Numerous high-boiling solvents for the dispersion of photographic dye couplers have been known. Thus DE-OS No. 2,129,684 teaches the use of Formamide, U.S. Pat. No. 2,533,514 the use of Dibutyllaurylamide and DE-OS No. 2,629,842 the use of benzoic acid ester.

It has also been known to utilize phthalic acid esters, tricresylphosphate or, according to DE-OS No. 2,042,581, phosphoric acid esters which in addition to aryl groups, also contain aliphatic groups, such as, for example, di-(n-hexyl)-phenylphosphate or tris-(2-ethylhexyl)-phosphate.

The solvents that are usually employed in the introduction process have a series of disadvantages. Thus they have insufficient dissolving capacity for the dye couplers and often need to be added in high concentrations, which leads to low dispersion stability and thereby to difficulties, especially in storage.

Further, it has been proposed (WP G 03 C/218404) to utilize phosphoric acid triamides or mixed phosphoric acid ester amides as high-boiling solvents for the introduction of hydrophobic couplers. Stable dispersions result. Utilization of the mentioned phosphoric acid amides is, however, restricted to certain types of dye couplers so that it is desirable to find new high-boiling solvents that have a wide spectrum of different hydrophobic dye couplers with which dispersions suitable for storage can be manufactured.

The object of the invention is to develop a process for the introduction of hydrophobic photographic additives, especially dye couplers, into gelatin or other hydrophilic bonding agents, which averts the disadvantages of the known processes, for instance, too low a dispersibility and, thereby, insufficient stability on storage.

The invention has the object of creating stable, permanent dispersions of photographic dye couplers through the utilization of a new high-boiling organic solvent.

SUMMARY OF THE INVENTION

In accordance with the present invention, this goal is achieved by employing phosphonic acid derivatives of the general formula

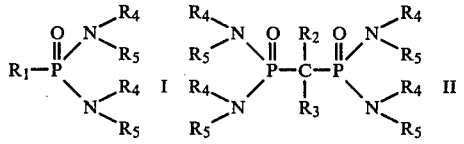

I II and/or

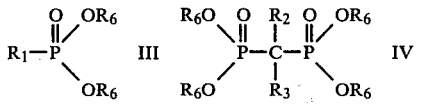

III IV and/or

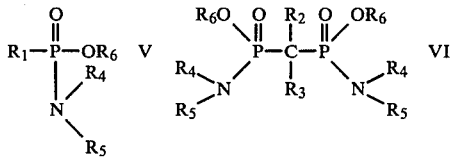

V VI

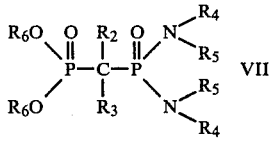

VII wherein $R_1$ represents aryl, methyl- or halogen-substituted aryl, alkyl with 1 to 14 carbon atoms or substituted alkyl of 1 to 14 carbon atoms; $R_2$ and $R_3$ represent hydrogen, alkyl of 1 to 14 carbon atoms, aryl, $—N(R_4)_2$ $—SR_4$, $—OR_4$; or $R_2$ may represent hydrogen and $R_3$ may represent alkyl of 1–14 carbon atoms, aryl, $—N(R_4)_2$, $—SR_4$, $—OR_4$; $R_4$ and $R_5$ represent alkyl with 1 to 14 carbon atoms; and $R_6$ represents alkyl with 1 to 14 carbon atoms, aryl, methyl- or halogen-substituted aryl, as high-boiling solvents.

DETAILED DESCRIPTION OF THE PREFERRED EMBODIMENTS

The compounds of this invention are manufactured by known processes, as described in Methoden Der Orgaischen Chemie (Houben-Weyl) 4th ed., vol. 12, Stuttgart 1963, or in the Journal for Practical Chemistry 317, 798 (1975). Some examples of such compounds are:

Phenyl phosphonic acid diethyl ester
Phenyl phosphonic acid dioctyl ester
Phenyl phosphonic acid bis-(di-n-butylamide)
Phenyl phosphonic acid ethyl ester-di-n-butylamide
Methane phosphonic acid dioctyl ester
Methane phosphonic acid-di-n-butylamide
Diethoxy methane phosphonic acid ethyl-2,4-dichloro phenylester
Diethoxy methane-phosphonic acid(1-n-octylethylene)-ester Methane bis-phosphonic acid tetra-n-butyl ester.

The amount of phosphonic acid derivatives to be inserted is 25 to 200%, proportionally to the amount of dye couplers, depending on the structure of the substances to be dispersed. It is also possible, and in certain cases even advantageous, to utilize mixtures of different phosphonic acid derivatives, such as phosphonic acid esters with phosphonic acid amides or with mixed phosphonic acid ester amides. All the solvents according to this invention, or mixtures thereof, may be employed in admixture with other known high-boiling solvents, such as phthalic acid esters. Low-boiling auxiliary solvents such as ethyl acetate or methylene chloride may also be employed which are again separated by distillation or washing before being poured out.

The dispersion is effected in a known manner, with the addition of substances that lower the interfacial tension and which may be used in the organic as well as in the aqueous phase or even in both phases. The known nonionic or anionic surface active agents are suitable for this purpose. Some examples are:

alkyl sulfate; alkylsulfonate; alkylaryl sulfonate; dialkylsulfosuccinate; polyoxyethylene alkylether and sulfate ester thereof, such as polyoxyethylene lauryl ether, polyoxyethylene oleylether or, sodium polyoxyethylene laurylether sulfate; polyoxyethylene alkylarylether and sulfate ester thereof, such as polyoxyethylene nonylphenylether or sodium polyoxyethylene dodecylphenylether sulfate; polyoxyethylene alkylester and sulfate ester thereof, such as polyoxyethylene stearic acid ester, polyoxyethylene palmitic acid ester or sodium polyoxyethylene stearic acid ester sulfate. Gelatin is preferably employed as a layer-forming colloid. Other known hydrophilic polymers, such as polyvinyl alcohol, polyvinyl pyrrolidone, polyacrylamide, cellulose derivatives or mixtures thereof may also be employed in combination with gelatin. The advantage of the process of this invention results in an increase of dispersion stability. Stable dispersions result which are distinguished by good compatibility of the solvents of the present invention with the hydrophilic bonding agents and good photographic qualities.

EXAMPLE OF EMBODIMENT

EXAMPLE 1:

10 g of a photographic blue-green coupler of the formula

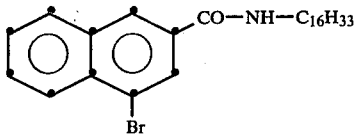

is dissolved in a mixture of 20 ml ethyl acetate and 10 ml phenyl phosphonic acid diethyl ester at 50° C. The solution obtained is emulsified in a mixture of 90 ml 10% gelatin solution and 20 ml 4% sodium dodecyl sulfate solution at 50° C. under high speed agitation. A homogeneous dispersion is obtained, from which the ethyl acetate is thereafter separated at 60° C. by distillation under reduced pressure. A sample of the dispersion is then poured onto a transparent base, resulting, after drying, in a clear layer, stable for storage. The dispersion is then added in a conventional manner to the casting solution of a highly sensitive photographic positive emulsion.

EXAMPLE 2

The following formation:

40 ml ethylacetate
15 ml methane bisphosphonic acid tetra-n-butylester
100 ml 5% gelatin solution
20 ml 8% sodium dihexylsulfosuccinate solution
is dispersed into 10 g of a photographic purple coupler of the formula

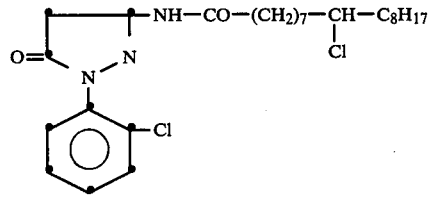

in a manner similar to that of Example 1.

After separation of the ethyl acetate by distillation under reduced pressure, a homogeneous dispersion precipitates which is further processed as in Example 1.

EXAMPLE 3

The following formulation:

100 ml ethylacetate
10 ml phenylphosphonic acid-dioctylester
10 ml phenylphosphonic acid-n-butylamide
150 ml 8% gelatin solution
60 ml 4% sodium dodecylsulfate solution is
dispersed into 20 g of a photographic purple coupler of the formula

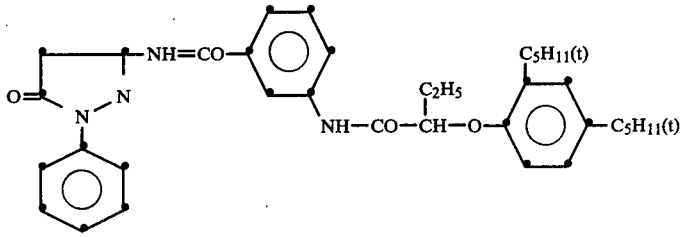

in a manner similar to that of Example 1.

A homogeneous dispersion is obtained, which solidifies after cooling off. The pulverized dispersion is then washed for 24 hours, in order to remove the ethyl acetate. After melting at 40° C., further processing occurs in a manner similar to that of Example 1.

EXAMPLE 4

The following formulation:

60 ml ethylacetate 12 ml phenylphosphonic acid ethylester-di-n-butylamide
100 ml 8% gelatin solution
30 ml 4% solution decylbenzene sulfonate solution
is dispersed into 15 g of a photographic yellow coupler of the formula

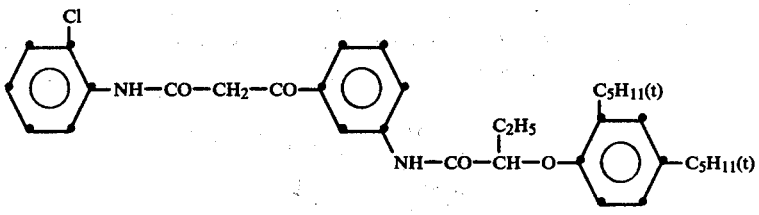

in a manner similar to that of Example 1.

After separation of the ethyl acetate by distillation under reduced pressure, a homogeneous dispersion results which is further processed in a manner similar to that described in Example 1.

EXAMPLE 5

The following formulation:
15 ml diethoxymethane-phosphonic acid-(1-n-octylethylene)-ester
180 ml 10% gelatin solution
50 ml 4% sodium dodecylsulfate solution is dispersed into 20 grams of a photographic blue-green coupler with the formula indicated in Example 1.

After separation by distillation of the ethyl acetate under reduced pressure, a homogeneous dispersion results which is further processed in a manner as indicated in Example 1.

We claim:

1. Process for the introduction of an hydrophobic photographic additive into a hydrophilic colloidal layer, wherein these additives are dissolved in an organic solvent that is not completely miscible with water and are subsequently dispersed in an aqueous medium, characterized in that at least one phosphonic acid diamide or methane bisphosphonic acid diamide of the general formulae

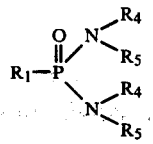

I

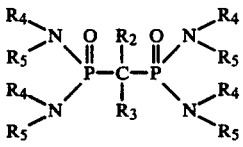

II and/or phosphonic acid esters or methane bisphosphonic acid esters of the general formulae

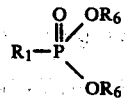

III

-continued

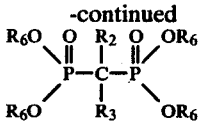

IV and/or mixed phosphonic acid esters amides or methane bisphosphonic acid esters of the general formulae

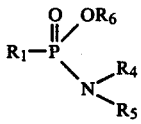

V

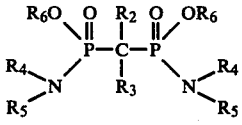

VI

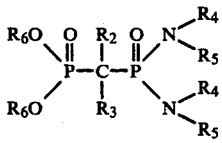

VII wherein $R_1$ represents aryl, methyl-substituted aryl, halogen-substituted aryl, alkyl with 1 to 14 carbon atoms or substituted alkyl; $R_2$ and $R_3$ represent hydrogen, alkyl, aryl, $—N(R_4)_2$, $—S—R_4$, $—OR_4$, or $R_2$ may represent hydrogen and $R_3$ represents alkyl, aryl, $—N(R_4)_2$, $—S—R_4$, $OR_4$, and $R_4$ and $R_5$ represents alkyl with 1 to 14 carbon atoms and $R_6$ alkyl with 1 to 14 carbon atoms, aryl, methyl-substituted aryl or halogen-substituted aryl, is used as a high-boiling solvent.

2. Process according to claim 1, characterized in that the high-boiling solvent is used in a proportionate amount of from 25 to 200%, to the additive to be dispersed.

3. The process of claim 1 comprising a mixture of at least a plurality of compounds I–VII.

4. The process of claim 3 comprising an additional solvent mixed with at least a plurality of compounds I–VII.

5. A dispersion comprising a surface active agent, a high-boiling solvent for the introduction of a water-insoluble photographic additive into an aqueous medium, said solvent comprising at least one phosphonic acid derivative of the following formulas I–VII:

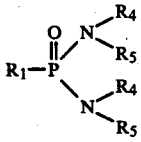

I

-continued

II

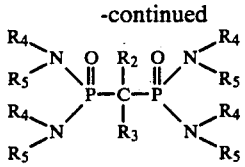

III

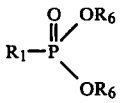

IV

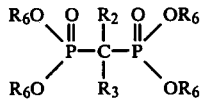

V

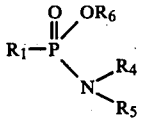

VI

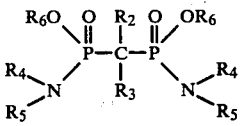

VII

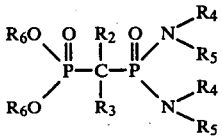

wherein $R_1$=aryl, methyl, halogen-substituted aryl, alkyl or substituted alkyl of 1 to 14 carbon atoms in length, $R_2$=$R_3$=hydrogen, alkyl, aryl, —$N(R_4)_2$, —$SR_4$, —$OR_4$, $R_2$ and $R_3$ being the same or different, $R_4$=$R_5$=alkyl of 1 to 14 carbon atoms in length, $R_4$ and $R_5$ being the same or different, and $R_6$=alkyl of 1 to 14 carbon atoms in length, aryl, methyl, or halogen-substituted aryl, said surface active agent, comprising at least one of alkyl sulfates, alkyl sulfonates, alkyl aryl sulfonates, dialkyl sulfosuccinates, polyoxyethylene alkylethers and/or sulfate esters thereof, polyoxyethylene alkylarylethers and/or sulfate esters thereof, and polyoxyethylene alkyl esters and/or sulfate esters thereof, and a hydrophilic substance, wherein said hydrophilic substance is gelatin.

6. The dispersion of claim 5 wherein said gelatin is mixed with at least one of polyvinyl alcohol, polyvinyl pyrrolidine, polyacrylamide, and cellulose derivatives.

7. The dispersion of claim 5 wherein said water insoluble photographic additive is a dye coupler.

8. The dispersion of claim 7 wherein (A) said dye coupler is

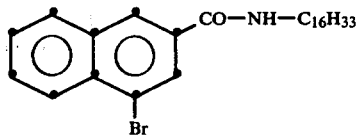

(B) said solvent is phenyl phosphonic acid diethyl ester, and (C) said surface active agent is sodium dodecyl sulfate.

9. The dispersion of claim 7 wherein (A) said dye coupler is

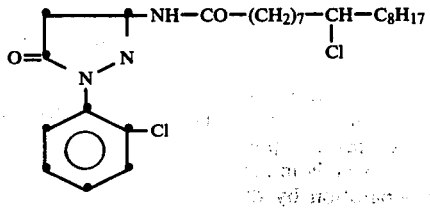

(B) said solvent is methane bisphosphonic acid tetra-n-butylester, and (C) said surface active agent is sodium dihexyl sulfosuccinate.

10. The dispersion of claim 7 wherein (A) said dye coupler is

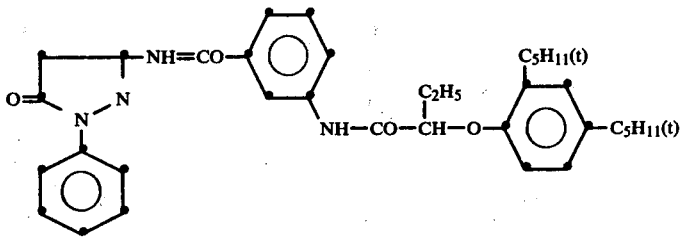

(B) said solvent comprises a mixture of phenylphosphonic acid-dioctylester and phenyl phosphonic acid-n-butylamide, and (C) said surface active agent is sodium dodecyl sulfate.

11. The dispersion of claim 7 wherein (A) said dye coupler is

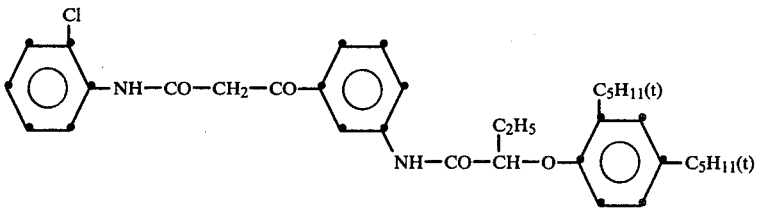

(B) said solvent is phenylphosphonic acid ethyl ester-di-n-butylamide, and (C) said surface active agent is sodium decylbenzene sulfonate.

12. The dispersion of claim 7 wherein (A) said dye coupler is

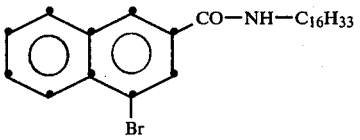

(B) said solvent is diethoxymethane-phosphonic acid-(1-n-octyl-ethylene) ester, and (C) said surface active agent is sodium dodecyl sulfate.

13. The dispersion of claims 8, 9, 10, 11, or 12, wherein ethyl acetate is initially added to said solvent (B), and subsequently removed after said dispersion is formed.

14. The process of claim 4 wherein said additional solvent is removed after dispersing said hydrophobic photograph additive in an aqueous medium.

15. The process of claim 14 additionally comprising mixing said solvent with an anionic and/or nonionic surface active agent.

16. The process of claim 15 wherein said hydrophobic photographic additive is a dye coupler.

17. The process of claim 16 wherein said hydrophilic colloid is gelatin.

* * * * *